US008882229B2

(12) United States Patent
Wu et al.

(10) Patent No.: US 8,882,229 B2
(45) Date of Patent: Nov. 11, 2014

(54) MEDIA WIDTH-BASED CALIBRATION PATTERN PLACEMENT

(71) Applicant: Hewlett-Packard Development Company, L.P., Houston, TX (US)

(72) Inventors: Chi-Shih Wu, Vancouver, WA (US); Justin M. Roman, Portland, OR (US); Theresa Gene Trueba Embree, Vancouver, WA (US); Erick B. Kinas, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/781,110

(22) Filed: Feb. 28, 2013

(65) Prior Publication Data

US 2014/0240389 A1 Aug. 28, 2014

(51) Int. Cl.

| | |
|---|---|
| ***B41J 29/38*** | (2006.01) |
| ***B41J 29/393*** | (2006.01) |
| ***B41J 2/01*** | (2006.01) |
| ***B41J 13/00*** | (2006.01) |
| ***B41J 11/42*** | (2006.01) |

(52) U.S. Cl.

CPC ..... *B41J 2/01* (2013.01); *B41J 13/0027* (2013.01); *B41J 11/42* (2013.01)

USPC ..... 347/16; 347/19; 347/104

(58) Field of Classification Search

CPC ..... B41J 13/0009; B41J 13/0027; B41J 11/42

See application file for complete search history.

(56) References Cited

U.S. PATENT DOCUMENTS

| | | | | |
|---|---|---|---|---|
| 5,404,022 | A * | 4/1995 | Stapleton | 250/559.36 |
| 5,671,163 | A | 9/1997 | Iida | |
| 7,573,600 | B2 | 8/2009 | Jeon et al. | |
| 7,922,278 | B2 | 4/2011 | Nishizaka | |
| 2002/0057308 | A1 * | 5/2002 | Iwasaki et al. | 347/41 |
| 2008/0198195 | A1 * | 8/2008 | Matsumura | 347/16 |
| 2008/0266348 | A1 * | 10/2008 | Seki et al. | 347/19 |
| 2009/0167806 | A1 * | 7/2009 | Kashimoto et al. | 347/16 |
| 2011/0205280 | A1 * | 8/2011 | Koshikawa et al. | 347/16 |
| 2012/0069075 | A1 | 3/2012 | Pawlik et al. | |
| 2013/0188202 | A1 * | 7/2013 | Toshima | 358/1.5 |

FOREIGN PATENT DOCUMENTS

| | | | |
|---|---|---|---|
| JP | 04122661 | A * | 4/1992 |
| JP | 2004244145 | | 9/2004 |
| JP | 2011173347 | | 9/2011 |

OTHER PUBLICATIONS

Understanding "dpi", (Research Paper), Feb. 2010.

* cited by examiner

*Primary Examiner* — Shelby Fidler
(74) *Attorney, Agent, or Firm* — Nathan Rieth

(57) ABSTRACT

In an embodiment, a processor-readable medium stores code representing instructions that when executed by a processor cause the processor to measure a width of a first-sized media page and determine a length that corresponds with the width. Based on the length, a bottom end of the first-sized media page is located, and a calibration pattern is printed in a first page region located relative to the bottom end of the first-sized media page.

17 Claims, 7 Drawing Sheets

MEDIA WIDTH-BASED CALIBRATION PATTERN PLACEMENT

BACKGROUND

Inkjet printing systems include scanning type systems and single-pass systems. In single-pass printing systems, printheads fixed on a stationary carriage or print bar, span the full width of the media and print images by ejecting ink across the media as it continually advances underneath the carriage in a direction perpendicular to the print bar. In scanning type printing systems, a scanning carriage holds one or more printheads and scans the printheads across the width of the media as the media is incrementally advanced between each scan in a direction perpendicular to the scanning. With each scan of the carriage across the media, the printhead(s) prints a single swath of an image, after which the media is advanced in a discrete increment in preparation for the next scan. Errors in the distance the media advances between scans of the carriage can result in print defects known as banding.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview

Figure 1:
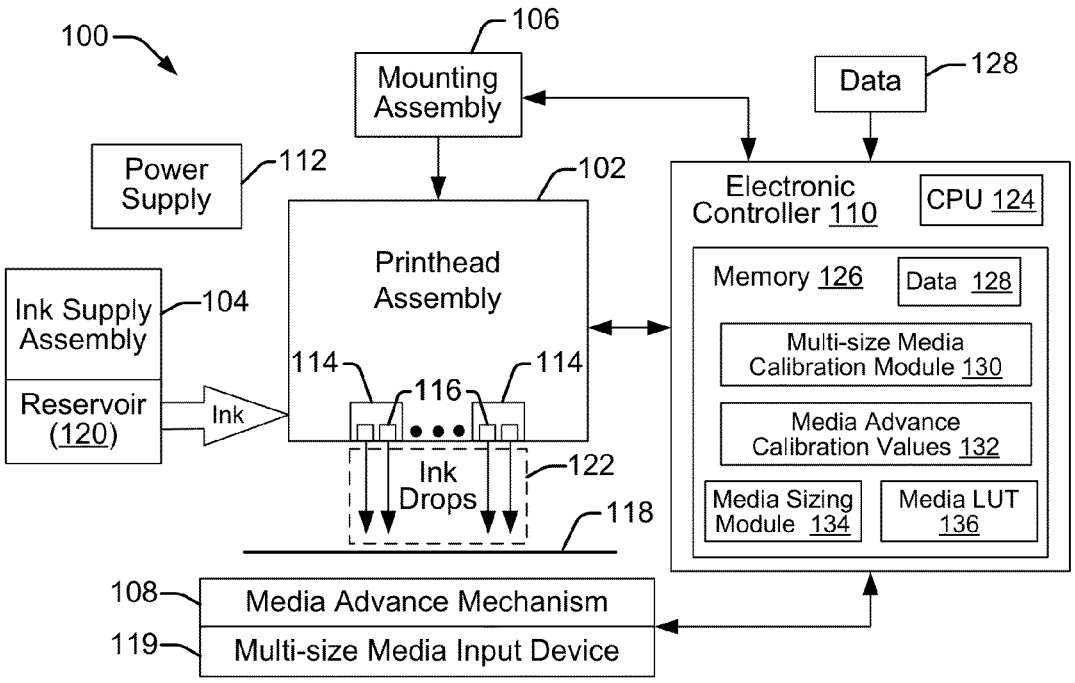
FIG. 1 shows an inkjet printing system suitable for implementing media width-based calibration pattern placement in a calibration method that compensates for media advance error, according to an embodiment.

As noted above, media advance errors in scanning inkjet print systems can result in print quality defects referred to as banding. A media advance error that over-feeds a print medium can cause white line banding, while a media advance error that under-feeds a print medium can cause dark line banding. To print a continuous image free from banding defects, the bottom edge of one printed swath should be aligned with the top edge of the next printed swath. The height of a printed swath is fixed for a given printhead, and when the media advancement exceeds the swath height, gaps between the printed swaths appear as white line banding on the printed image. Alternatively, when the media advancement is less than the swath height, overlapping swaths create a "shingle" appearance referred to as dark line banding.

Banding defects are caused by paper handling features within a printer's media path that influence how the media advances through the printer. For example, a pick roller that picks a media page (e.g., a page of paper) from a paper tray causes drag against the page as the page moves along the media path. The drag on the page produces a media advance error. When the trailing edge of the page leaves the pick roller so that it is no longer in contact with the roller, the media advance error changes. In general, as a media page moves through a printer's media path, the media advance error changes several times as the page engages and disengages different media advance rollers and other features along the path. Therefore, different page regions encounter different levels of media advance error. Or, conversely, changes in the media advance error define different page regions. Transitions between different page regions are where banding defects are likely to begin, end, or change in appearance, due to these changes in the media advance error.

Depending on the length of a media page, media advance error caused by some features in the media path may not contribute to a banding defect. For example, with shorter media pages, media advance error attributed to the pick roller may not influence a printable region of the page because the trailing edge of the page typically clears the pick roller before printing begins. Conversely, with a longer media page, printing typically begins before the page disengages from the pick roller, so the media advance error from the pick roller influences the page within a printable page region. Regardless of size, however, both short and long media pages experience one or more transitions in media advance error as the pages encounter features along the print media path, such as the feed roller, intermediate media advance roller, etc. Because longer media pages may encounter more transitions in media advance error than shorter pages, they may have one or more additional page regions than shorter media pages.

Prior methods of addressing banding defects involve calibrating the print media advance error. Calibration can be performed both at the factory during printer manufacture and in-the-field by the user. In-the-field calibration typically involves the printer generating a user-readable plot, after which the user either provides feedback on a preferred pattern, or scans the plot back into the printer. This type of calibration is often time consuming and can result in errors related to user feedback and/or user misplacement of the plot onto the printer's scanning mechanism. Factory calibration also has disadvantages including increased costs associated with additional space and calibration operators, the inability to address printer wear that occurs over the life of the printer, and the inability to account for different media types that a user might place into the printing device.

A more recent calibration method involves advancing a print medium to a set distance from the top of the page and printing a calibration line pattern using two different parts of a printhead. Where the lines printed by one part of the printhead line up with the lines printed by the other part of the printhead, the print medium is lighter or has higher reflectance. The brightness level at this location is detected by a sensor and used to determine the best alignment. Calibration values are then stored based on this alignment and applied to the printer's media advance mechanism during subsequent print jobs to compensate for the media advance error along the media path.

This method of calibrating for media advance error works well when a print job media size is the same as the calibration media size. However, various printing products use multiple media sizes (e.g., A, A4, B, A3, . . . ), and it is inefficient to have to calibrate the media advance error separately for each media size. Instead, calibration values determined from one media size should apply to all media sizes. Unfortunately, placing the calibration pattern at the same location relative to the top of a page for any given media size, results in calibration values that do not apply optimally to other media sizes. Thus, applying media advance calibration values to a print job having a media size different than the calibration media size can result in banding defects. Avoiding banding defects using this method would unfortunately involve performing a separate calibration for each media size in a multi-size media printing device.

Embodiments of the current disclosure improve on prior efforts to reduce banding defects caused by print media advance error, generally through a calibration method that uses media width to place calibration patterns on media so that calibrations of media advance error can be accurately applied to varying media sizes. For printing devices that can print to multiple media sizes, calibration values determined using any one of the media sizes can be applied to any other media size without additional calibration or recalibration. Instead of printing calibration patterns at a location relative to the top of the page, the disclosed calibration method prints calibration patterns at a location relative to the bottom of the page. However, while printers can determine a location relative to the top of a page as it enters the media path, they are generally incapable of knowing the exact location of the end, or bottom, of the page. Therefore, to print calibration patterns at the same location relative to the bottom of a page, regardless of the media size, the disclosed calibration method first measures the width of the media using a spot sensor on the side of a scanning printhead carriage. The length of the media being calibrated is then extrapolated from the width using standard media size associations. Based on the media length, the page is advanced to a position that ensures that calibration patterns are printed at the same relative location from the bottom end of the page, regardless of the media length. The method determines media advance calibration values and stores them for use on subsequent print jobs of any media size enabled by the printer. Printing calibration patterns at the same location relative to the bottom of the page ensures the calibration values correspond to the same page positions and levels of media advance error regardless of the media size used for the calibration.

In one example, a processor-readable medium stores code representing instructions that when executed by a processor cause the processor to measure a width of a first-sized media page, and determine a length that corresponds with the width. Based on the length, a bottom end of the first-sized media page is located, and a calibration pattern is printed in a first page region located relative to the bottom end of the first-sized media page.

In another example, a printing device includes a sensor and a media look-up table (LUT). A media sizing module causes the sensor to measure a width of a first-sized media page, and to determine a corresponding length from the LUT. A calibration module establishes a bottom end of the media page from the length, determines a location relative to the bottom end that corresponds with a defined page region, and prints a calibration pattern at the location.

In another example, a processor-readable medium stores code representing instructions that when executed by a processor cause the processor to retrieve a first-sized media page from a multi-size media input device. The processor further measures a media width and notes a top-of-page location of the first-sized media page as it enters a printer media path. The processor associates a media length with the media width and determines a bottom-of-page location based on the media length and the top-of-page location. The processor controls the placement of a calibration pattern on the first-sized media page in a page region at a predetermined distance from the bottom-of-page location and calculates a media advance error and corresponding calibration value from the calibration pattern. The processor retrieves a second-sized media page from the multi-size media input device and applies the calibration value to compensate for media advance error in a same page region on the second-sized media page.

Illustrative Embodiments

FIG. 1 illustrates an inkjet printing system 100 suitable for implementing media width-based calibration pattern placement in a calibration method that compensates for media advance error, according to an embodiment of the disclosure. Inkjet printing system 100 includes an inkjet printhead assembly 102, an ink supply assembly 104, a mounting assembly 106, a media advance mechanism 108, an electronic printer controller 110, and at least one power supply 112 that provides power to the various electrical components of inkjet printing system 100. Inkjet printhead assembly 102 includes at least one fluid ejection assembly 114 (printhead 114) that ejects drops of ink through a plurality of orifices or nozzles 116 toward a media page 118 so as to print onto the media page 118. Typically, nozzles 116 are arranged in one or more columns or arrays such that properly sequenced ejection of ink from nozzles 116 causes characters, symbols, and/or other graphics or images to be printed upon a media page 118 as inkjet printhead assembly 102 and the media page 118 are moved relative to each other. A media page 118 can be any suitable type of cut sheet print media, such as paper, card stock, transparencies, Mylar, and the like. In addition, inkjet printing system 100 can print to multiple media sizes and includes a multi-size media input device 119, such as a paper input tray. Multi-size media input device 119 provides multiple sizes of media to media advance mechanism 108 which transports the media along a print media path within printing system 100.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form a one-way ink delivery system or a recirculating ink delivery system. In a one-way ink delivery system, substantially all of the ink supplied to inkjet printhead assembly 102 is consumed during printing. In a recirculating ink delivery system, only a portion of the ink supplied to printhead assembly 102 is consumed during printing. Ink not consumed during printing is returned to ink supply assembly 104.

In one implementation, inkjet printhead assembly 102 and ink supply assembly 104 are housed together in an inkjet cartridge or pen. In this case, reservoir 120 includes a local reservoir located within the cartridge, but may also include a larger reservoir located separately from the cartridge to refill the local reservoir through an interface connection, such as a supply tube. In another implementation, ink supply assembly 104 is separate from inkjet printhead assembly 102 and supplies ink to inkjet printhead assembly 102 through an interface connection. In either case, reservoir 120 of ink supply assembly 104 may be removed, replaced, and/or refilled.

Figure 2:
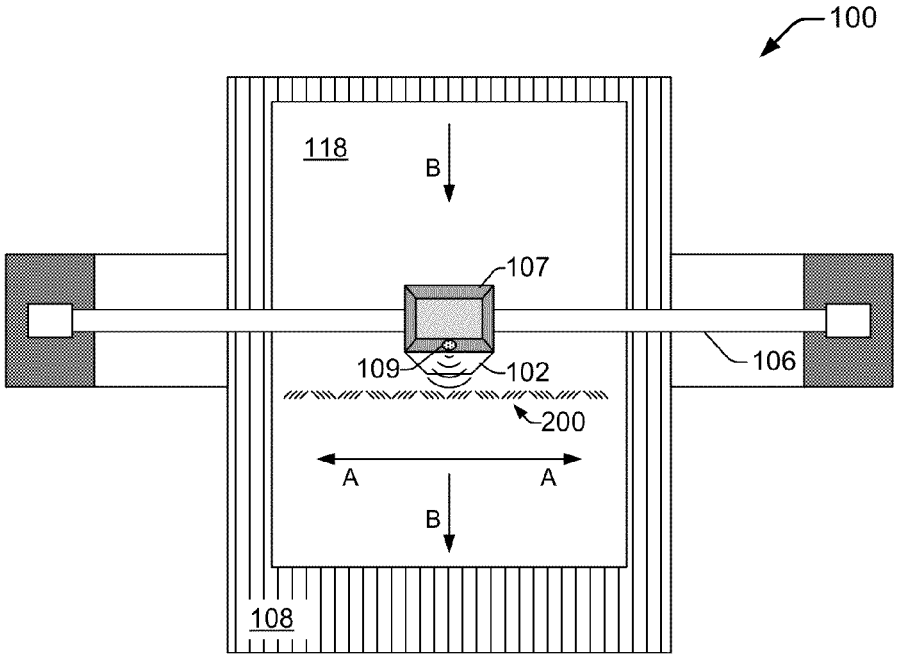
FIG. 2 shows an example of a scanning type inkjet printing system, according to an embodiment.

Mounting assembly 106 positions inkjet printhead assembly 102 relative to the media advance mechanism 108, and the media advance mechanism 108 positions media page 118 relative to the inkjet printhead assembly 102. Thus, a print zone 122 is defined adjacent to nozzles 116 in an area between inkjet printhead assembly 102 and media page 118. In one implementation, inkjet printing system 100 is a scanning type printer where inkjet printhead assembly 102 is a scanning printhead assembly. FIG. 2 illustrates an example of a scanning type inkjet printing system 100, according to an embodiment of the disclosure. In a scanning type inkjet printing system 100, mounting assembly 106 includes a carriage 107 that scans inkjet printhead assembly 102 in forward and reverse passes across the width of the media page 118 in a generally horizontal manner, as indicated by horizontal arrows labeled A. Between carriage scans, the media page 118 is incrementally advanced by media advance mechanism 108, as indicated by the vertical arrows labeled B. Thus, media advance mechanism 108 moves the media page 118 through the printer 100 along a print media path that properly positions media page 118 relative to inkjet printhead assembly 102 as drops of ink are ejected onto the page 118.

Media advance mechanism 108 can include various mechanisms (not shown in FIGS. 1 and 2) that assist in advancing a media page 118 through a media path of printing system 100. These can include, for example, a variety of media advance rollers (discussed in more detail below with regard to FIG. 3), a moving platform, a motor such as a DC servo motor or a stepper motor to power the media advance rollers and/or moving platform, combinations of such mechanisms, and so on.

In addition to carriage 107, mounting assembly 106 includes a sensor 109 fixed to the carriage 107. Sensor 109 is a lightness/spot sensor that scans a calibration pattern 200 printed on a media page 118 and measures reflectance from the media page 118, as discussed below. In addition, sensor 109 is controllable to measure the width of a media page 118 by scanning the page to determine the locations of the edges of the page. Sensor 109 generally comprises a device and associated electronics that transmit, direct, refract and/or reflect light or other electromagnetic energy toward printing composition (e.g., a printed calibration pattern 200) on a media page 118 to detect the quantity or amount of light or other electromagnetic energy reflected from or absorbed by the printing composition on the media page 118.

Referring again to FIG. 1, electronic controller 110 includes a processor (CPU) 124, a memory 126, firmware, and other printer electronics for communicating with and controlling inkjet printhead assembly 102, mounting assembly 106, media advance mechanism 108, and media input device 119. Memory 126 comprises a non-transitory computer/processor-readable storage medium that can include any device or non-transitory medium able to store code and/or data for use by a computer system. Thus, memory 126 can include, but is not limited to, volatile (i.e., RAM) and non-volatile (e.g., ROM, hard disk, floppy disk, CD-ROM, etc.) memory components comprising computer/processor-readable media that provide for the storage of computer/processor-readable coded instructions, data structures, program modules, and other data for printing system 100.

Electronic controller 110 receives data 128 from a host system, such as a computer, and stores the data 128 in memory 126. Typically, data 128 is sent to inkjet printing system 100 along an electronic, infrared, optical, or other information transfer path. Data 128 represents, for example, a document or image file to be printed. As such, data 128 forms a print job for inkjet printing system 100 that includes one or more print job commands and/or command parameters. Data 128 can also include instructions or commands that specify a media size to be used for a print job. Thus, using data 128, electronic controller 110 controls media advance mechanism 108 to select an appropriate media page size from media input device 119, and it controls inkjet printhead assembly 102 to eject ink drops from nozzles 116 onto the page. In this way, electronic controller 110 defines a pattern of ejected ink drops that form characters, symbols, and/or other graphics or images on media page 118.

In one implementation, electronic controller 110 includes a multi-size media calibration module 130, media advance calibration values 132, a media sizing module 134, and a media LUT (look-up table) 136, stored in memory 126. As discussed in more detail below, multi-size media calibration module 130 and media sizing module 134 comprise instructions executable on processor 124 to control components of printing system 100 and determine calibration values 132 used to calibrate media advance error for the media advance mechanism 108. The media LUT 136 includes data that describes the dimensions and other characteristics of the variously-sized media accessible to the printer system 100 from the multi-size media input device 119. In general, media advance error measured within one or more page regions on a media page 118 is calibrated in order to control the media advance mechanism 108 such that the error is compensated when printing print jobs of various media sizes. As noted above, the media advance error is generated by various features within the print media path of a printer 100 (e.g., media advance rollers) that influence how a media page 118 advances through the media path.

Figure 3:
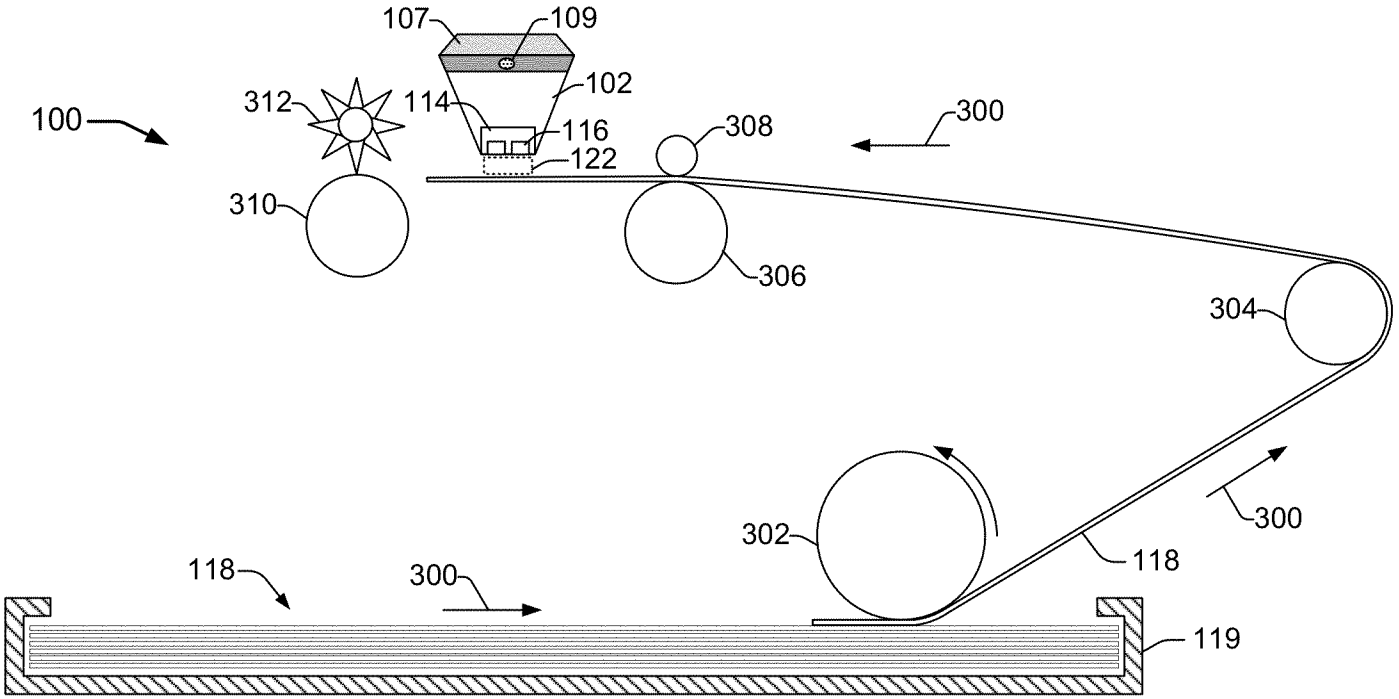
FIG. 3 shows a side view of an example printing system that illustrates one example configuration of media advance rollers, according to an embodiment.

FIG. 3 shows a side view of an example printing system 100 that illustrates one example configuration of media advance rollers, according to an embodiment of the disclosure. FIG. 3 illustrates a sheet-fed printer configuration that uses pre-cut paper of different sizes. While FIG. 3 illustrates a particular number of media advance rollers that are referenced in a particular manner and configured in a particular way, it is noted that other printers and printing systems may have various other roller configurations having a greater or fewer number of rollers positioned in different locations and referenced in different ways. It should be understood that the concepts conveyed and encompassed by the embodiments disclosed herein are equally applicable to printers and printing systems with such varying media advance roller configurations.

Referring to FIG. 3, a variety of media advance rollers are used to advance media pages 118 through printing system 100 along a media path generally indicated by arrows 300. In this example, a pick roller 302 takes the media page 118 from a media input device 119 off the top of a stack of media pages, and moves it along the media path 300. An intermediate roller 304, advances the media page 118 around a curved path such that the page 118 continues to advance along media path 300. The media page 118 is then further advanced through the print zone 122 by the feed roller 306 and idler roller 308. A discharge roller 310 and star wheel 312 then advance the media page 118 further along the media path 300 as it exits the printer 100.

As previously noted, each media advance roller applies drag to the media page. The combined drag from one or more rollers causes the media advance error. As the trailing edge of the page clears a roller, the overall drag is reduced and the media advance error changes. Each change in media advance error defines a different page region, and calibrating the media advance error enables the media advance mechanism 108 to compensate for the error within each page region. However, calibration values determined using one media size will not apply correctly to compensate for media advance error in other media sizes unless they correspond to the same page region (i.e., having the same level of media advance error) within the different media sizes. Therefore, while calibrating using any given media size, calibration patterns should be placed within page regions that correspond with other media sizes.

Figure 4A:
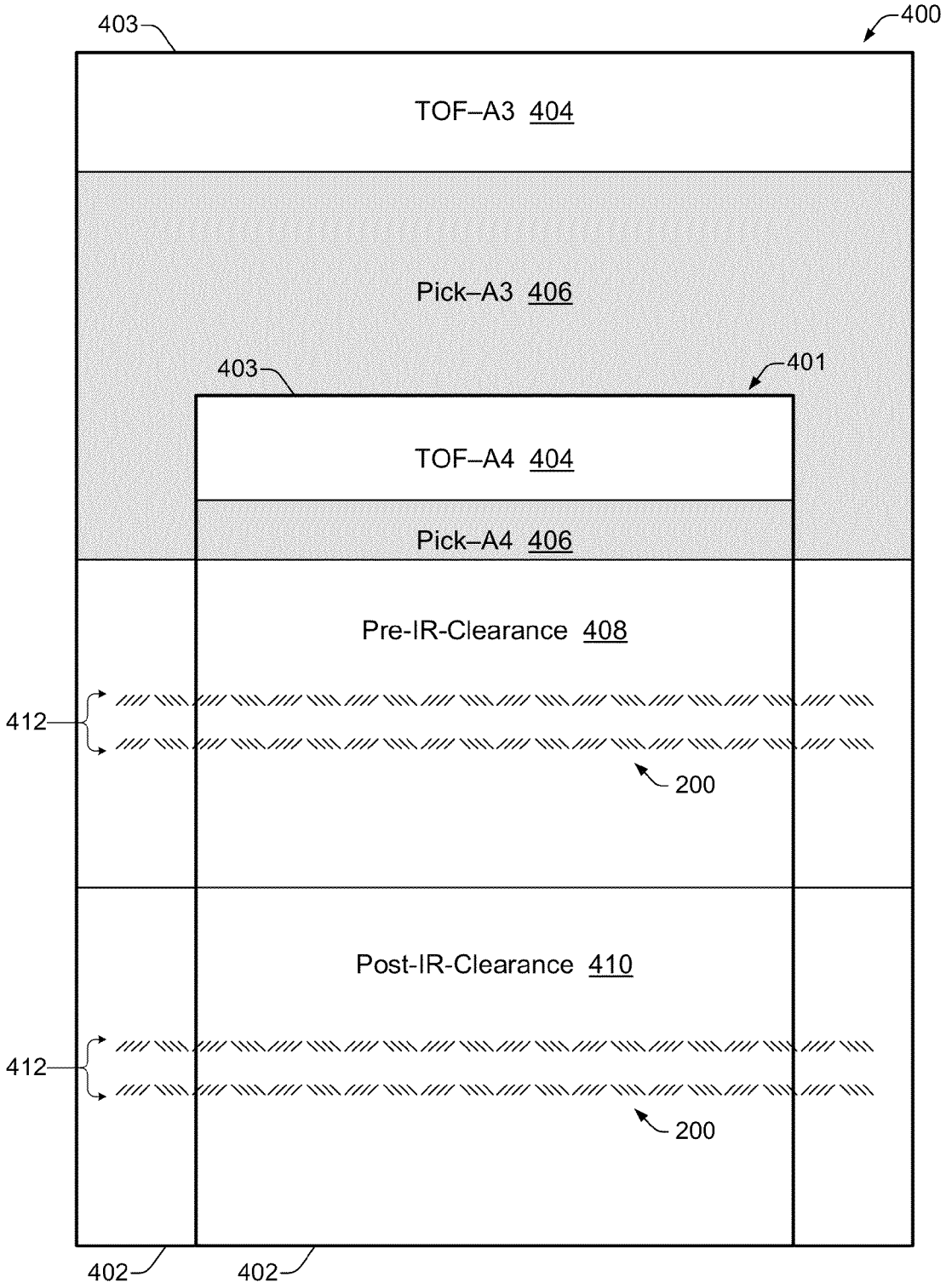
FIGS. 4*a* and 4*b* show examples of media pages of different sizes that illustrate relative positions of page regions on different sized media pages, according to an embodiment.
Figure 4B:
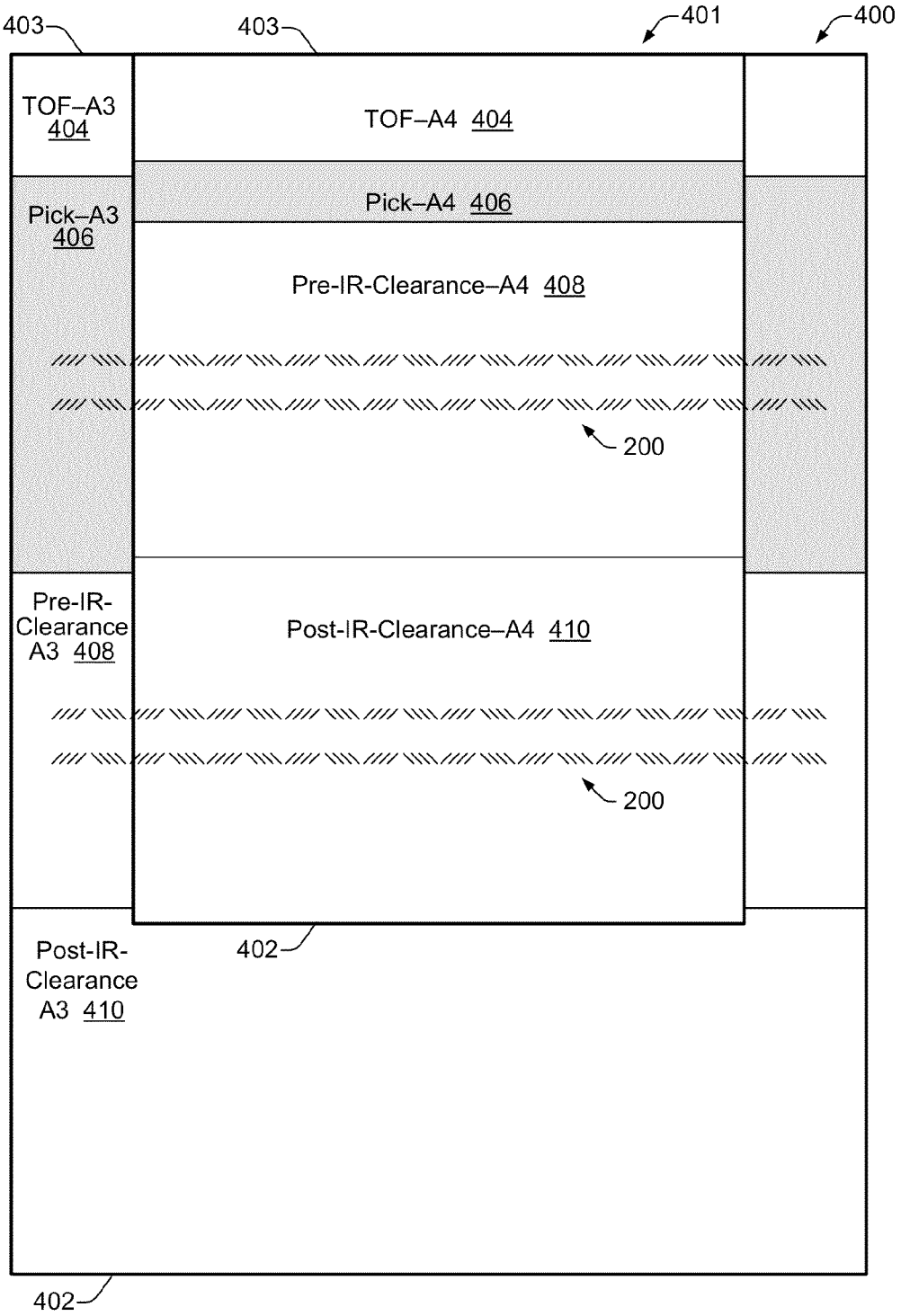

FIGS. 4*a* and 4*b* help to illustrate this point with two media pages 400, 401, of different sizes (e.g., A3 and A4) that show the relative positions of page regions on the different sized pages. FIG. 4*a* shows the media pages 400 and 401 aligned at the end/bottom 402 of the pages, and illustrates that when calibration patterns 200 are placed on a media page at a set location relative to the end/bottom 402 of the page, the alignment of the page regions enables the patterns 200 to be positioned within the same page region for both media sizes. Thus, calibration values determined using either sized media page 400 or 401, can be applied to the other media page because the media advance error being calibrated is the same for either media size within the equivalent page regions. By contrast, FIG. 4*b* shows the media pages 400 and 401 aligned at the tops 403 of the pages, and illustrates that when calibration patterns 200 are placed on a media page at a set location relative to the top 403 of the page, the misalignment of the page regions does not permit the patterns 200 to be positioned within the same page region for both media sizes. Thus, calibration values determined using either sized media page 400 or 401, cannot be accurately applied to the other media page because the page regions between the media sizes are not equivalent, and the media advance error being calibrated for using one media size will not be the same for the other media size.

Referring to both FIGS. 4*a* and 4*b*, starting from the top 403 of each page 400, 401, the first region is the TOF 404 (top-of-form) region. The TOF 404 is the page region that is the first to enter and exit the media path 300 of printer 100. In this example, the TOF 404 is a page region in which there will be no printing. The pick region 406 is where the media page 118 is engaged by the pick roller 302. Depending on the page size, while in the pick region 406, the page may also be engaged by other media rollers further along in the media path 300, such as the intermediate roller 304, the feed roller 306 and idler roller 308, and possibly the discharge roller 310 and star wheel 312. A first media advance error is associated with the pick region 406 and is caused by drag on the page from the pick roller 302, and possibly other media rollers further along the media path. The pre-IR-clearance region 408 (IR refers to intermediate roller) begins when the trailing edge of the media page 118 clears the pick roller 302. Thus, in the pre-IR-clearance region 408, the page 118 is engaged by the intermediate roller 304 (i.e., the page has not yet cleared the IR), but is not engaged by the pick roller 302. In the pre-IR-clearance region 408, the media page 118 may also be engaged by the feed roller 306 and idler roller 308, and possibly the discharge roller 310 and star wheel 312. A second media advance error is associated with the pre-IR-clearance region 408 and is caused by drag on the page from the intermediate roller 304, and possibly other media rollers further along the media path. The post-IR-clearance region 410 begins when the trailing edge of the media page 118 clears the intermediate roller 304. Therefore, the post-IR-clearance region 410 is where the media page 118 is engaged by the feed roller 306 and idler roller 308, but not by the intermediate roller 304 (i.e., the page has cleared the IR). In the post-IR-clearance region 410, the page 118 may also be engaged by the discharge roller 310 and star wheel 312. A third media advance error is associated with the post-IR-clearance region 410 and is caused by drag on the page from the feed roller 306 and idler roller 308, and possibly the discharge roller 310 and star wheel 312.

Referring still to FIG. 4*a*, and again to electronic controller 110 in FIG. 1, the multi-size media calibration module 130 executes on processor 124 to calibrate media advance error and determine calibration values 132 that are used to control the media advance mechanism 108 for compensating the media advance error. Typically, the media advance error is calibrated for multiple page regions (e.g., pre-IR-clearance 408, post-IR-clearance 410, pick region 406). Calibrating the media advance error in each of the page regions begins with measuring the media advance error in each page region. To measure the media advance error in each page region, the processor 124, executing instructions from calibration module 130, controls inkjet printhead assembly 102 and printhead 114 to print a number of lines 412 of a calibration pattern 200 into each page region.

Figure 5:
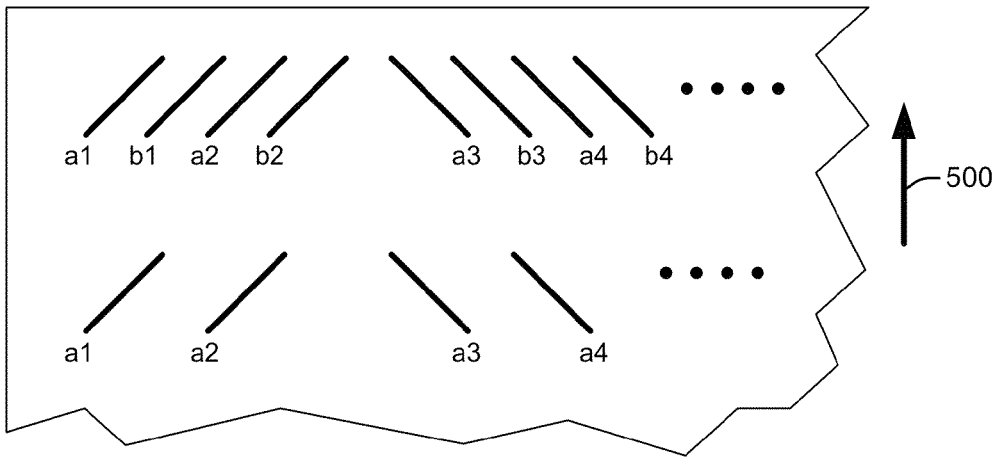
FIG. 5 shows a magnified version of a calibration pattern, according to an embodiment.
Figure 6:
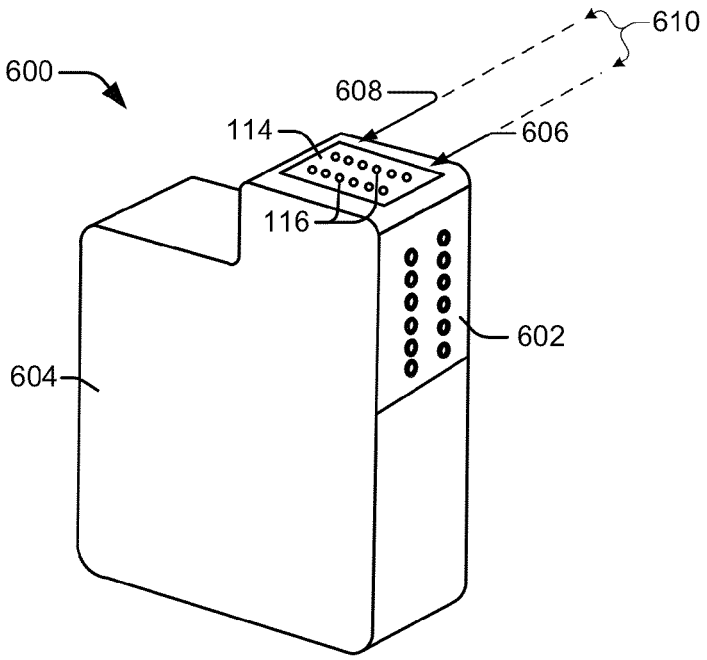
FIG. 6 shows a perspective view of an example inkjet cartridge (or pen) that includes an inkjet printhead assembly and ink supply assembly, according to an embodiment.

FIG. 5 shows a magnified version of an example calibration pattern 200, according to an embodiment. FIG. 6 shows a perspective view of an example inkjet cartridge 600 (or pen 600) that includes inkjet printhead assembly 102 and ink supply assembly 104 (FIG. 1), according to an embodiment of the disclosure. In addition to one or more printhead dies 114, inkjet cartridge 600 includes electrical contacts 602 and an ink (or other fluid) supply chamber 604. As shown in FIG. 5, printing the calibration pattern 200 includes printing a first pattern of first elements a1, a2, a3, and a4, advancing the media page 118 in the direction indicated by arrow 500, and then printing a second pattern of second elements b1, b2, b3, and b4, where the second elements are interleaved among the first elements. The first pattern of first elements a1, a2, a3, and a4, is printed with the bottom most 606 nozzles 116 on printhead 114, or, those nozzles 116 located closest to the bottom end of the printhead 114 and cartridge 600, as shown in FIG. 6. The second pattern of second elements b1, b2, b3, and b4, is printed with the top most 608 nozzles 116 on printhead 114, or, those nozzles 116 located closest to the top end of the printhead 114 and cartridge 600. The distance 610 between the bottom 606 nozzles and top 608 nozzles on the printhead 114 acts as a ruler that defines the height of a print swath. Therefore, if there is no media advance error, the advancement of the media page 118 between printing the first elements and the second elements should precisely align the first elements with the second elements. However, as discussed below, a difference in alignment between the first elements and the second elements is what determines the amount of media advance error.

As each line 402 of the calibration pattern 200 is printed, the sensor 109 scans the calibration pattern 200 and measures reflectance from the pattern 200 printed on media page 118. Based on the amount of light or energy detected by the sensor 109, the processor 124 compares the first pattern of first elements (a1, a2, a3, and a4) with the second pattern of second elements (b1, b2, b3, and b4), and determines the media advance error based on the difference in relative positions of the first and second patterns. The processor 124 makes this determination by calculating a best fit center of area (i.e., a "centroid") of the signal response from the sensor 109 for both the first elements (a1, a2, a3, and a4), and the second elements (b1, b2, b3, and b4). Using the centroids calculated from the first elements and the second elements, the processor 124 determines a print media advance error. In this manner, the media advance error for each page region is determined. Additional details regarding the specific techniques used in determining the centroids and the print media advance error can be found in patent application, U.S. Ser. No. 13/688,551, of Erick Blane Kinas, filed Nov. 29, 2012, and titled "Calibration Apparatus", the content of which is incorporated herein by reference in its entirety.

While the media advance error can be determined based on a single line 402 of the calibration pattern 200, in other implementations the media advance error for a page region is determined based on all of the lines 402 of the calibration pattern 200 within that page region. This is achieved by determining a media advance error for each line 402 within a page region, as discussed above. The media advance errors determined for each individual line 402 within the page region are then averaged to determine an average media advance error for the page region.

The media advance error for each page region is then used to calculate a media advance calibration value 132. The calibration values 132 are stored in a memory 126 (FIG. 1), as noted above. The calibration values 132 are the values used to drive, or control, the media advance mechanism 108 enabling it to compensate for the media advance error measured within each page region. Thus, once the calibration values 132 have been calculated and stored in memory for each page region, when a subsequent media page 118 is printed, the calibration values 132 are retrieved from memory and used to drive the media advance mechanism 108. A calibration value 132 associated with a given page region drives the media advance mechanism 108 at a rate uniquely suited to compensate for the media advance error previously measured for that page region.

Figure 7:
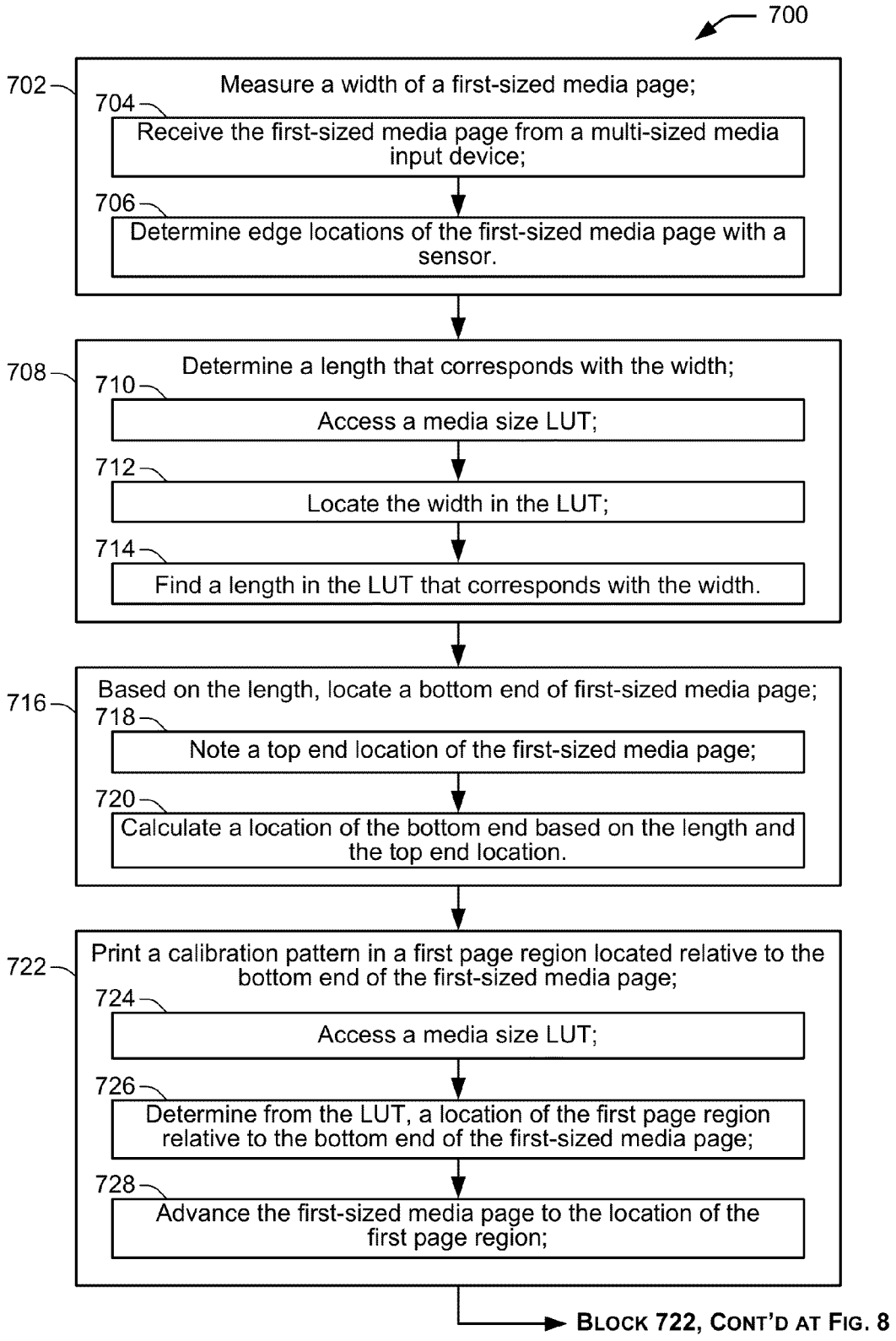
FIGS. 7 and 8 show flowcharts of an example method related to a media advance error calibration method that places calibration patterns on media based on the media width, according to an embodiment.
Figure 8:
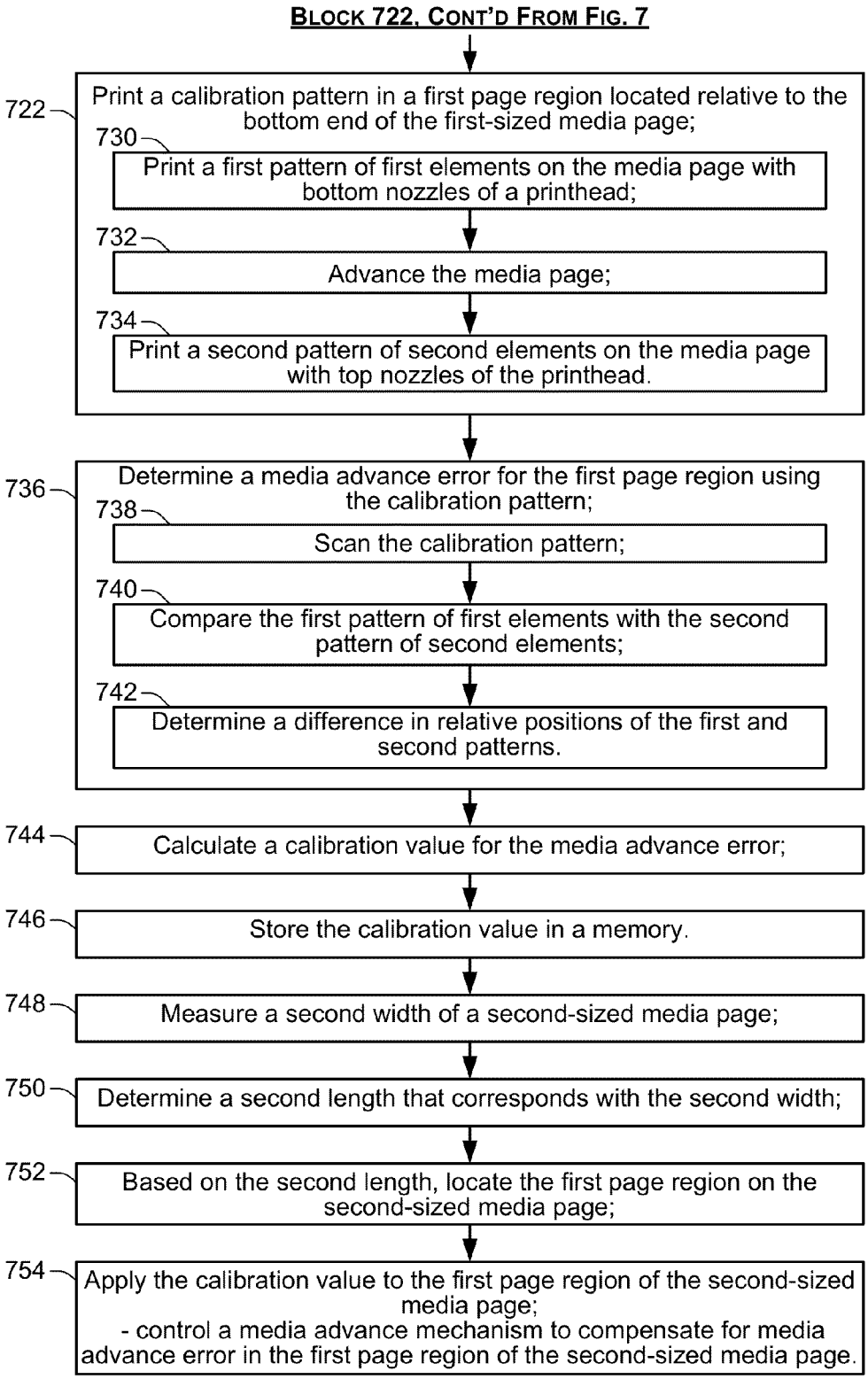

FIGS. 7 and 8, show flowcharts of an example method 700, related to a media advance error calibration method that places calibration patterns on media based on the media width, according to an embodiment of the disclosure. Method 700 is associated with the embodiments discussed above with regard to FIGS. 1-6, and details of the steps shown in method 700 can be found in the related discussion of such embodiments. The steps of method 700 may be embodied as programming instructions stored on a non-transitory computer/processor-readable storage medium, such as memory 126 of FIG. 1. In an example, the implementation of the steps of method 700 is achieved by the reading and execution of such programming instructions by a processor, such as processor 124 of FIG. 1. Method 700 may comprise additional implementations that do not employ each step presented in the flowcharts. Therefore, while steps of method 700 are presented in a particular order within the flowcharts, the order of their presentation is not intended to be a limitation as to the order in which the steps may actually be implemented, or as to whether all of the steps may be implemented. For example, one implementation of method 700 might be achieved through the performance of a number of initial steps, without performing one or more subsequent steps, while another implementation of method 700 might be achieved through the performance of all of the steps.

Method 700 of FIG. 7, begins at block 702, where the first step shown is to measure a width of a first-sized media page. Measuring the width of the media page generally includes receiving the media page from a multi-sized media input device 119 and determining the locations of the media edges, as indicated at blocks 704 and 706. At block 708, the method 700 continues with determining a media length that corresponds with the media width. The media length can be determined by accessing a media size LUT (710) that includes information about the characteristics of many standard media types. The measured width of the media page is located in the LUT and the corresponding length is then found through an association within the LUT, as shown at blocks 712 and 714. In general, accessing the LUT and associating the media width and length identifies the media size of the first-sized media page.

At block 716, the bottom end of the first-sized media page is located based on the media length. As indicated at blocks 718 and 720, the location of the top end of the media page is first noted as the page enters the media path, and the location of the bottom end is then calculated based on the media length extending from the top end. At block 722, a calibration pattern is printed on the first-sized media page in a first page region (e.g., a pre- or post-IR-clearance region) at a location relative to the bottom end of the media page. As shown at blocks 724-728, printing the calibration pattern can include accessing the media size LUT, determining from the LUT, a location of the first page region relative to the bottom end of the first-sized media page, and advancing the first-sized media page to the location of the first page region. In some implementations, printing a calibration pattern includes printing multiple lines of the calibration pattern.

The method 700 continues at FIG. 8 as shown at blocks 730-734, where printing the calibration pattern further includes printing a first pattern of first elements on the media page with bottom nozzles of a printhead, advancing the media page, and printing a second pattern of second elements on the media page with top nozzles of the printhead. In some implementations, printing the calibration pattern includes printing the calibration pattern in multiple page regions, each located relative to the bottom end of the first-sized media page. In this case, a media advance error is determined from the calibration patterns for each of the multiple page regions, and calibration values for each page region are stored in memory.

At block 736, the method 700 continues with determining a media advance error for the first page region using the calibration pattern. As indicated at blocks 738-742, determining the media advance error includes scanning the calibration pattern, comparing the first pattern of first elements with the second pattern of second elements, and determining a difference in relative positions of the first and second patterns. Where multiple lines of the calibration pattern have been printed in the first page region, the media advance error can be determined by averaging individual media advance errors determined for each line of the calibration pattern.

At block 744, a calibration value is calculated for the media advance error, and then stored in memory as shown in block 746. The calibration value can later be applied to different sized media. For example, as shown at block 748, a second width of a second-sized media page is measured. A second length that corresponds with the second width can then be determined (through the LUT) and used to locate the first page region on the second-sized media page, as shown at blocks 750 and 752. The calibration value is then applied to the first page region of the second-sized media page by controlling a media advance mechanism to compensate for media advance error in the first page region of the second-sized media page, as shown at block 754. As noted above, calibration values for multiple page regions can be determined and stored in memory. Multiple calibration values can be similarly applied to different media sizes to compensate for media advance errors within the respective page regions of the different sized media pages.

What is claimed is:

1. A non-transitory processor-readable medium storing code representing instructions that when executed by a processor cause the processor to:

measure a width of a first-sized media page;

determine a length that corresponds with the width;

based on the length, locate a bottom end of the first-sized media page; and print a calibration pattern in a first page region located relative to the bottom end of the first-sized media page, wherein to print the calibration pattern in the first page region, the instructions further cause the processor to:

access a media size look-up table (LUT);

determine from the LUT, a location of the first page region relative to the bottom end of the first-sized media page; and advance the first-sized media page to the location of the first page region.

2. The non-transitory processor-readable medium as in claim 1, wherein the instructions further cause the processor to:

determine a media advance error for the first page region using the calibration pattern;

calculate a calibration value for the media advance error; and store the calibration value in a memory.

3. The non-transitory processor-readable medium as in claim 2, wherein to determine the media advance error, the instructions further cause the processor to:

scan the calibration pattern, the calibration pattern including a first pattern of first elements and a second pattern of second elements;

compare the first pattern of first elements with the second pattern of second elements; and determine a difference in relative positions of the first and second patterns.

4. The non-transitory processor-readable medium as in claim 2, wherein the instructions further cause the processor to:

measure a second width of a second-sized media page;

determine a second length that corresponds with the second width;

based on the second length, locate the first page region on the second-sized media page; and apply the calibration value to the first page region of the second-sized media page.

5. The non-transitory processor-readable medium as in claim 4, wherein to apply the calibration value, the instructions further cause the processor to control a media advance mechanism to compensate for media advance error in the first page region of the second-sized media page.

6. The non-transitory processor-readable medium as in claim 1, wherein to print the calibration pattern, the instruction further cause the processor to print the calibration pattern in multiple page regions, each of the multiple page regions being located relative to the bottom end of the first-sized media page.

7. The non-transitory processor-readable medium as in claim 6, wherein the instructions further cause the processor to:

determine a media advance error for each of the multiple page regions using the calibration patterns;

calculate a calibration value for the media advance error in each of the multiple page regions; and store the calibration values in a memory.

8. The non-transitory processor-readable medium as in claim 7, wherein the instructions further cause the processor to:

measure a second width of a second-sized media page;

determine a second length that corresponds with the second width;

based on the second length, locate the multiple page regions on the second-sized media page; and apply the calibration values to respective multiple page regions of the second-sized media page.

9. The non-transitory processor-readable medium as in claim 1, wherein to measure the width, the instructions further cause the processor to:

receive the first-sized media page from a multi-sized media input device; and determine edge locations of the first-sized media page with a sensor.

10. The non-transitory processor-readable medium as in claim 1, wherein determine the length, the instructions further cause the processor to:

locate the width in the LUT; and find a length in the LUT that corresponds with the width.

11. The non-transitory processor-readable medium as in claim 1, wherein to print the calibration pattern, the instructions further cause the processor to:

print a first pattern of first elements on the media page with bottom nozzles of a printhead;

advance the media page; and print a second pattern of second elements on the media page with top nozzles of the printhead.

12. The non-transitory processor-readable medium as in claim 1, wherein to print the calibration pattern, the instructions further cause the printer to print multiple lines of the calibration pattern in the first page region.

13. The non-transitory processor-readable medium as in claim 12, wherein to determine the media advance error, the instructions further cause the processor to:

determine a media advance error for each line of the calibration pattern; and average the media advance errors.

14. A printing device comprising:

a sensor;

a media look-up table (LUT);

a media sizing module to cause the sensor to measure a width of a first-sized media page, and to determine a corresponding length from the LUT; and a calibration module to establish a bottom end of the media page from the length, to determine a location relative to the bottom end that corresponds with a defined page region, and to print a calibration pattern at the location, wherein to print the calibration pattern at the location, the calibration module is further to access the LUT, determine a location of the first page region relative to the bottom end of the first-sized media page from the LUT, and advance the first-sized media page to the location of the first page region.

15. The printing device as in claim 14, wherein the calibration module is further to:

determine a media advance error for the defined page region;

calculate a calibration value for the media advance error; and store the calibration value in a memory.

16. The printing device as in claim 14, further comprising:

a multi-sized media input device to input media pages of different sizes;

wherein the media sizing module is to cause the sensor to measure a width of a second-sized media page, and to determine a corresponding second length from the LUT; and the calibration module is to determine from the second length, a location on the second-sized media page that corresponds with the defined page region, and to apply the calibration value to the defined page region of the second-sized media page.

17. The non-transitory processor-readable medium storing code representing instructions that when executed by a processor cause the processor to:

retrieve a first-sized media page from a multi-size media input device;

measure a media width and note a top-of-page location of the first-sized media page as it enters a printer media path;

associate a media length with the media width;

determine a bottom-of-page location based on the media length and the top-of-page location;

place a calibration pattern on the first-sized media page in a page region at a predetermined distance from the bottom-of-page location, wherein to place the calibration pattern on the first-sized media page, the instructions further cause the processor to access a media size look-up (LUT), determine a location of the page region relative to the bottom-of-page location of the first-sized media page from the LUT, and advance the first-sized media page to the location of the page region;

calculate a media advance error and corresponding calibration value from the calibration pattern;

retrieve a second-sized media page from the multi-size media input device; and apply the calibration value to compensate for the media advance error in a same page region of the second-sized media page.

* * * * *